US007073929B2

(12) United States Patent
Iwasaki

(10) Patent No.: US 7,073,929 B2
(45) Date of Patent: Jul. 11, 2006

(54) HEADLAMP

(75) Inventor: Kazunori Iwasaki, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 0 days.

(21) Appl. No.: 11/068,046

(22) Filed: Mar. 1, 2005

(65) Prior Publication Data

US 2005/0248956 A1 Nov. 10, 2005

(30) Foreign Application Priority Data

Mar. 2, 2004 (JP) ..... 2004-057987

(51) Int. Cl.
*F21V 7/00* (2006.01)
*F21V 11/00* (2006.01)

(52) U.S. Cl. ..... 362/517; 362/539; 362/297; 362/345

(58) Field of Classification Search ..... 362/517, 362/518, 538, 539, 297, 346
See application file for complete search history.

(56) References Cited

U.S. PATENT DOCUMENTS 6,471,383 B1 * 10/2002 Oyama et al. ..... 362/517
6,966,675 B1 * 11/2005 Albou ..... 362/517

FOREIGN PATENT DOCUMENTS

JP 2002-197905 A 7/2002
JP 2003-007109 A 1/2003
JP 2003-338209 A 11/2003
JP 3488960 B2 11/2003

* cited by examiner

*Primary Examiner*—Stephen F Husar
(74) *Attorney, Agent, or Firm*—Foley & Lardner LLP

(57) ABSTRACT

The headlamp is provided with a main reflector having a main reflecting surface, a light source, a projector lens, a first subreflector having a first sub-reflecting surface, a second subreflector having a second sub-reflecting surface, and a third subreflector having a third sub-reflecting surface.

8 Claims, 9 Drawing Sheets

HEADLAMP

CROSS-REFERENCE TO RELATED APPLICATIONS

The present document incorporates by reference the entire contents of Japanese priority document, 2004-057987 filed in Japan on Mar. 2, 2004.

BACKGROUND OF THE INVENTION

1) Field of the Invention

The present invention relates to a projector-type headlamp.

2) Description of the Related Art

Conventional headlamps can be found in Japanese Patent No. 2003-338209, Japanese Unexamined Patent Publication No. 2003-7109, Japanese Unexamined Patent Publication No. 2002-197905 and so forth.

These headlamps have a light source, a main reflector and a plurality of subreflectors. When the light source is turned on, the main reflector creates a main light distribution pattern, and the subreflectors effectively utilize a portion of this light, which usually results in becoming ineffective, to thereby creating a sub-light distribution pattern. In this way, the headlamps can effectively utilize the light.

However, most of these conventional headlamps are designed such that the main light distribution pattern and the sub-light distribution pattern overlap, and not configured to irradiate a left outer side and a right outer side, which are dead angles of the main light distribution pattern, thus failing in fully effectively utilizing the light.

An exception is the headlamp disclosed in Japanese Patent No. 3488960. This publication discloses a technique of directing the sub-light distribution pattern to the left side of the main light distribution pattern. Even in this technique, however, only a limited portion of the sub-light distribution pattern is directed to the left side of the main light distribution pattern, and a sufficient luminosity (illuminance and quantity of light) cannot be obtained.

Japanese Patent No. 3488960 also discloses a technique of rotating a subreflector so as to direct the sub-light distribution pattern to the left side or the right side of the main light distribution pattern. However, this technique requires rotating the subreflector in a wide range from left to right, which lowers the efficiency.

SUMMARY OF THE INVENTION

It is an object of the present invention to at least solve the problems in the conventional technology.

According to an aspect of the present invention, a projector-type headlamp includes a main reflector that includes a main reflecting surface that is substantially an ellipsoid of revolution having a first focal point and a second focal point; the light source located on or substantially close to the first focal point; a projector lens that projects outward a predetermined light distribution pattern, the projector lens having a third focal point, wherein the projector lens is arranged such that the third focal point is located on or substantially close to the second focal point; a first subreflector with a first sub-reflecting surface that is substantially an ellipsoid of revolution having a fourth focal point and a fifth focal point, wherein the first subreflector is arranged such that the fourth focal point is located on or substantially close to the first focal point, and the first sub-reflecting surface reflects a portion of light output from the light source that usually results in becoming ineffective toward the fifth focal point; a second subreflector with a second sub-reflecting surface that is substantially an ellipsoid of revolution having a sixth focal point and a seventh focal point, wherein the second subreflector is arranged such that the sixth focal point is located on or substantially close to the fifth focal point, and the second sub-reflecting surface reflects light reflected from the first sub-reflecting surface toward the seventh focal point; a third subreflector with a third sub-reflecting surface that is substantially a paraboloid of revolution having an eighth focal point, wherein the third subreflector is arranged such that the eighth focal point is located on or substantially close to the seventh focal point, and the third sub-reflecting surface reflects light reflected from the second sub-reflecting surface toward the outside on a left outer side or a right outer side with respect to the predetermined light distribution pattern.

The other objects, features, and advantages of the present invention are specifically set forth in or will become apparent from the following detailed description of the invention when read in conjunction with the accompanying drawings.

DETAILED DESCRIPTION

Figure 1:
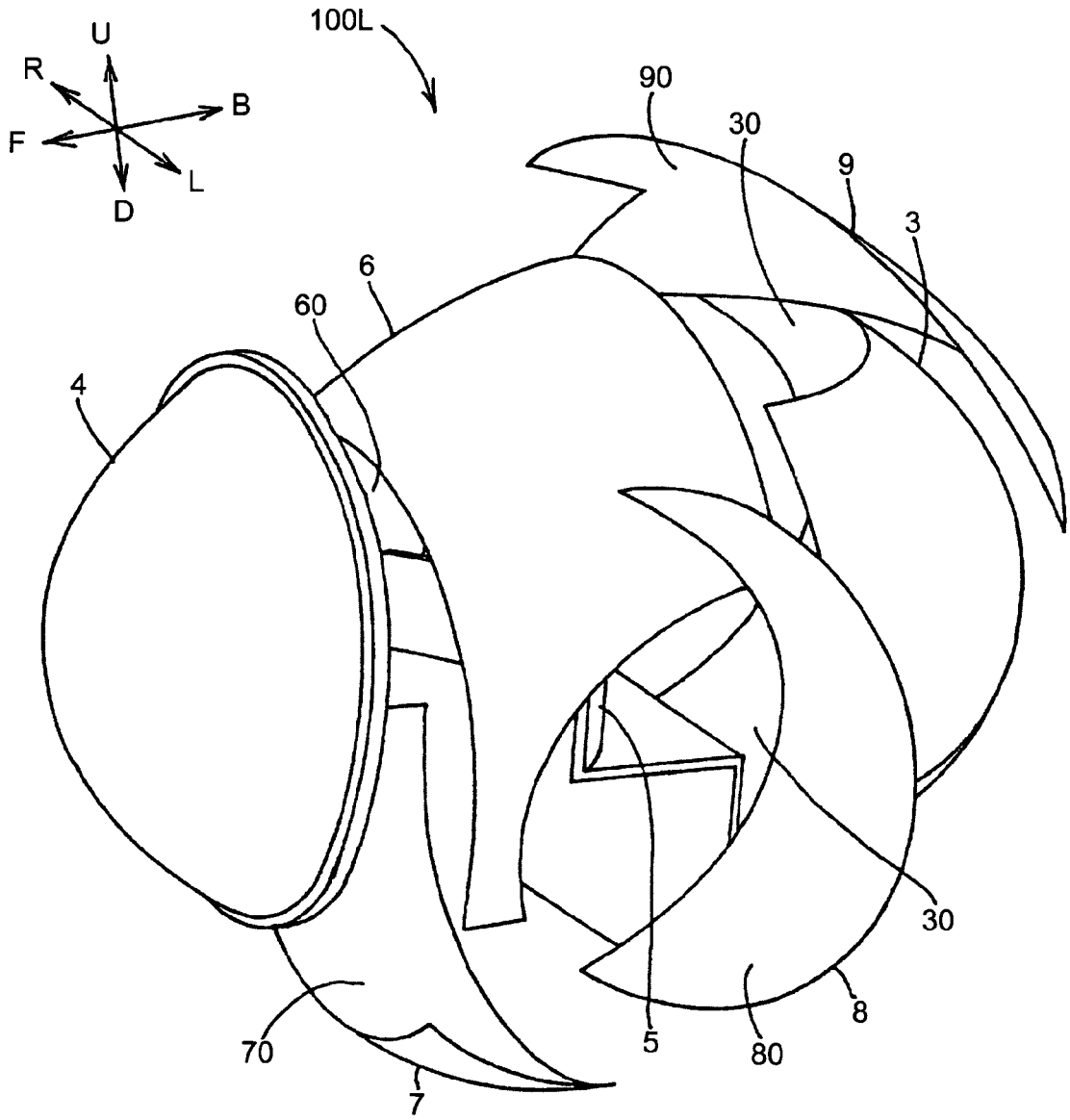
FIG. 1 is a fragmentary perspective view of a headlamp according to an embodiment of the present invention.

Exemplary embodiments of a headlamp according to the present invention will be described in detail hereunder, referring to the accompanying drawings. It is to be noted, however, that the present invention is not limited to the embodiment.

A structure of the headlamp according to the embodiment will be explained. In the drawings, VU-VD is a vertical line passing through an optical axis Z—Z of the headlamp, as a well as a vertical line on a screen. HL-HR is a horizontal line passing through the optical axis Z—Z, as well as a horizontal line on a screen. F is a front side of a vehicle C (a forward driving direction of the vehicle C). B is a rear side, U is an upper side, D is a lower side, L is a left side of the vehicle, and R is a right side, all with respect to the driver the vehicle. The terms left outer side, right outer side, left lower side, right lower side, left side, and right side used in the claims have the meaning described above herein and in the drawings.

Figure 11:
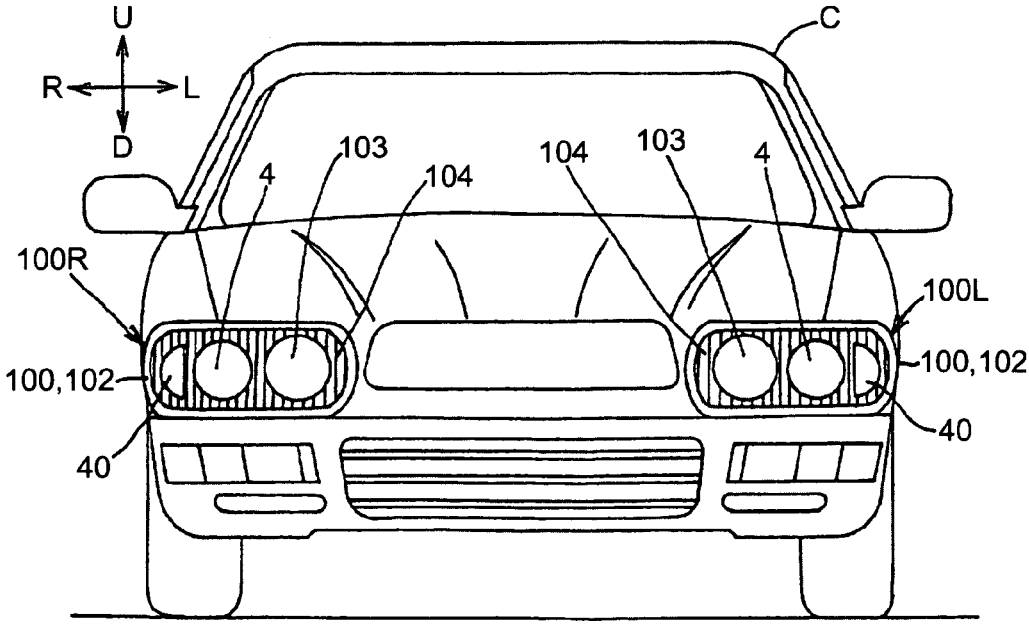
FIG. 11 is a front view of the vehicle which the headlamps shown in FIG. 1 mounted on the left and right sides.

Referring to FIG. 11, a headlamp 1 according to the embodiment includes a headlamp assembly 100L mounted on the left side and a headlamp assembly 100R mounted on the right side of the vehicle C. The headlamp assemblies 100L and 100R have almost the same configuration, therefore, the headlamp assemblies 100L will only be explained here. The headlamp assembly 100L includes a light housing 101 and an outer lens (light lens) 102 defining a light chamber (not shown), a driving headlamp unit (not shown) and a passing headlamp unit. A portion of the outer lens 102, other than the portions corresponding to a projector lens 103 of the driving headlamp unit, a projector lens 4 of the passing headlamp unit, and an inner lens 40 of the passing headlamp unit, is formed into a vertical prism 104 that functions as a blind on the light chamber. A portion of the light chamber, other the portions corresponding to the projector lens 103, the projector lens 4, and the inner lens 40, is covered with an inner panel (or an inner housing or an extension, not shown in FIG. 11) so that structure inside the light chamber is not seen from the outside.

The headlamp 1 will be described below with reference to FIGS. 1 to 10. The following description refers to the headlamp assembly 100L. The structure of the headlamp assembly 100R is generally symmetrical with that of the headlamp assembly 100L, except the configuration of some of the parts. The headlamp assembly 100L is of a projector type. The headlamp assembly 100L includes a light source (not shown), a main reflector 3, a projector lens (condenser lens) 4, a shade 5, a first subreflector 6, a second subreflector 7, a third subreflector 8, and a fourth subreflector 9.

The light source may be a discharge light such as a high-pressure metal vapor discharge lamp including a so-called metal halide lamp, a high intensity discharge lamp (HID), or a halogen lamp. The light source is removably attached to the main reflector 3 via a socket mechanism (not shown). A center F1 of a light emitting section of the light source is located on or near a first focal point F31 of a main reflecting surface 30 of the main reflector 3. The center F1 and the first focal point F31 are located substantially at the same position (refer to FIG. 6).

The inner concave surface of the main reflector 3 is finished with aluminum vapor deposition or silver coating, thus forming the main reflecting surface 30, which is substantially an ellipsoid of revolution (NURBS surface of free-form surface). The main reflecting surface 30 has an elliptical vertical cross-section, and a paraboloidal or a modified paraboloidal horizontal cross-section as in FIG. 5. Accordingly, the main reflecting surface 30 has the first focal point F31 and a second focal point (a caustic on the horizontal cross-section) F32. The main reflector 3 is fixedly held by a holder or a frame (not shown; hereinafter, simply a holder). The main reflecting surface 30 reflects a portion (not shown) of light from the light source, to thereby utilize the portion as a passing light distribution pattern LP. Therefore, light except the portion reflected by the main reflecting surface 30 out of the light from the light source (light L1 represented by solid arrow lines in FIG. 6, i.e. direct light irradiated upwardly forward by the light source) usually results in becoming ineffective.

The projector lens 4 includes a non-spherical lens, a condenser lens, a convex lens and so forth. A front face of the projector lens 4 presents a non-spherical convex surface, while a rear face thereof presents a non-spherical plane. A focal point F4 of the projector lens 4 is located on or near a second focal point F32 of the main reflecting surface 30. For example, a focal plane (meridional image plane) F4 on an object space side of the projector lens 4 is located ahead of the second focal point F32. The second focal point F32 and the focal point F4 are located substantially at the same position (refer to FIG. 6). The projector lens 4 is fixedly held by a holder. The projector lens 4 serves to outwardly project the reflected light (not shown) from the main reflecting surface 30, but excluding the portion of the reflected light (not shown) cut off by the shade 5, in the form of the passing light distribution pattern LP (refer to FIGS. 9 and 10).

The shade 5 cuts off a portion of the reflected light from the main reflecting surface 30, and utilizes the remaining reflected light to form the passing light distribution pattern LP. The shade 5 is provided with a wedge 50 along an upper end thereof, which serves as a cut-off line CL for the passing light distribution pattern LP. The wedge 50 of the shade 5 is located on or near the second focal point F32 and the focal point F4. The wedge 50 of the shade 5, the second focal point F32 and the focal point F4 are located substantially at the same position (refer to FIG. 6). The shade 5 is fixedly held by a holder.

The passing light distribution pattern LP and the shade 5 are designed on the assumption that the vehicle C drives on the left side, and when the vehicle C drives on the right side, the configuration of the passing light distribution pattern LP and the shade 5 become generally symmetrical with that of the left-side drive.

Figure 4:
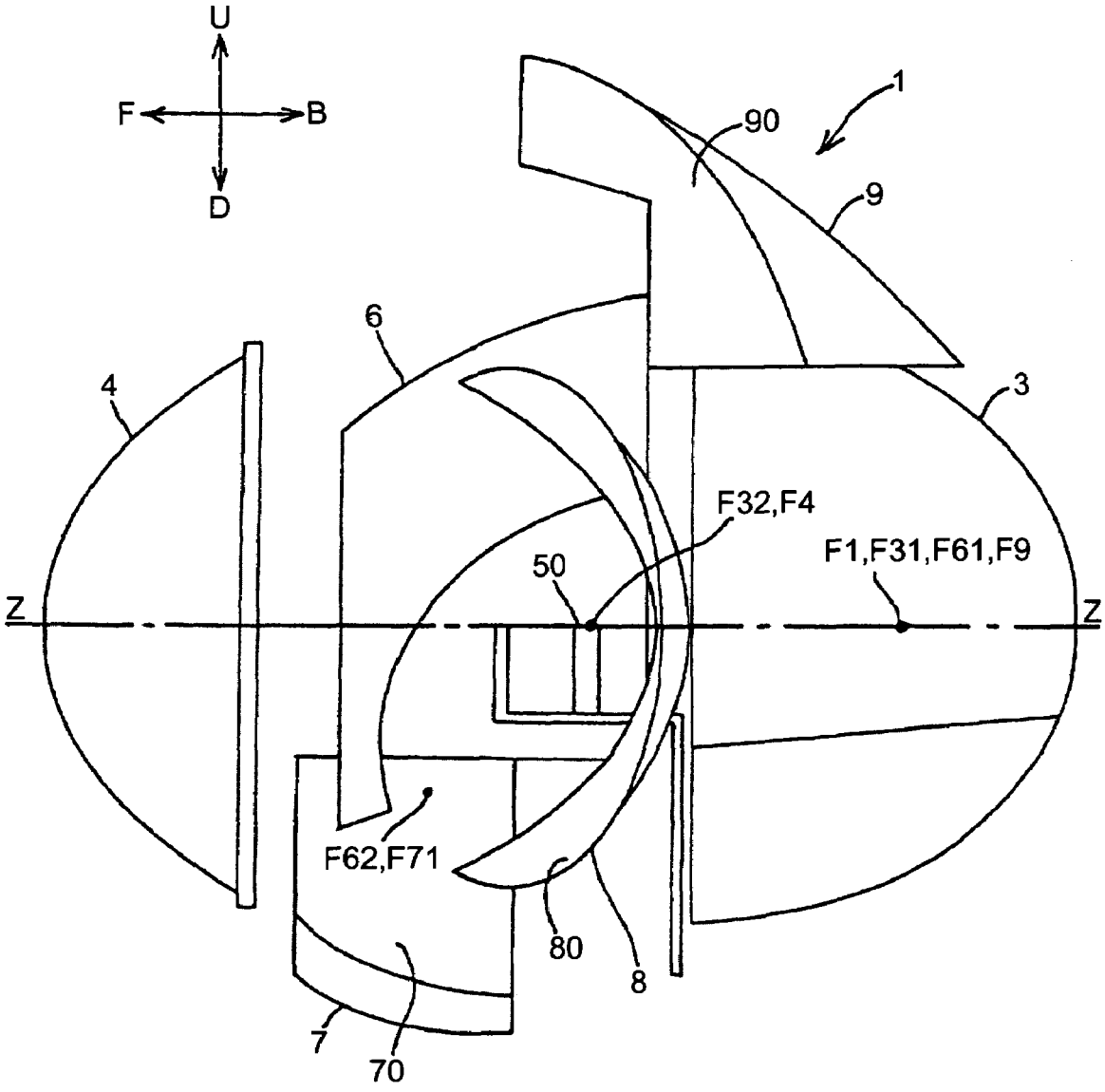
FIG. 4 is a side view of the headlamp shown in FIG. 2.
Figure 6:
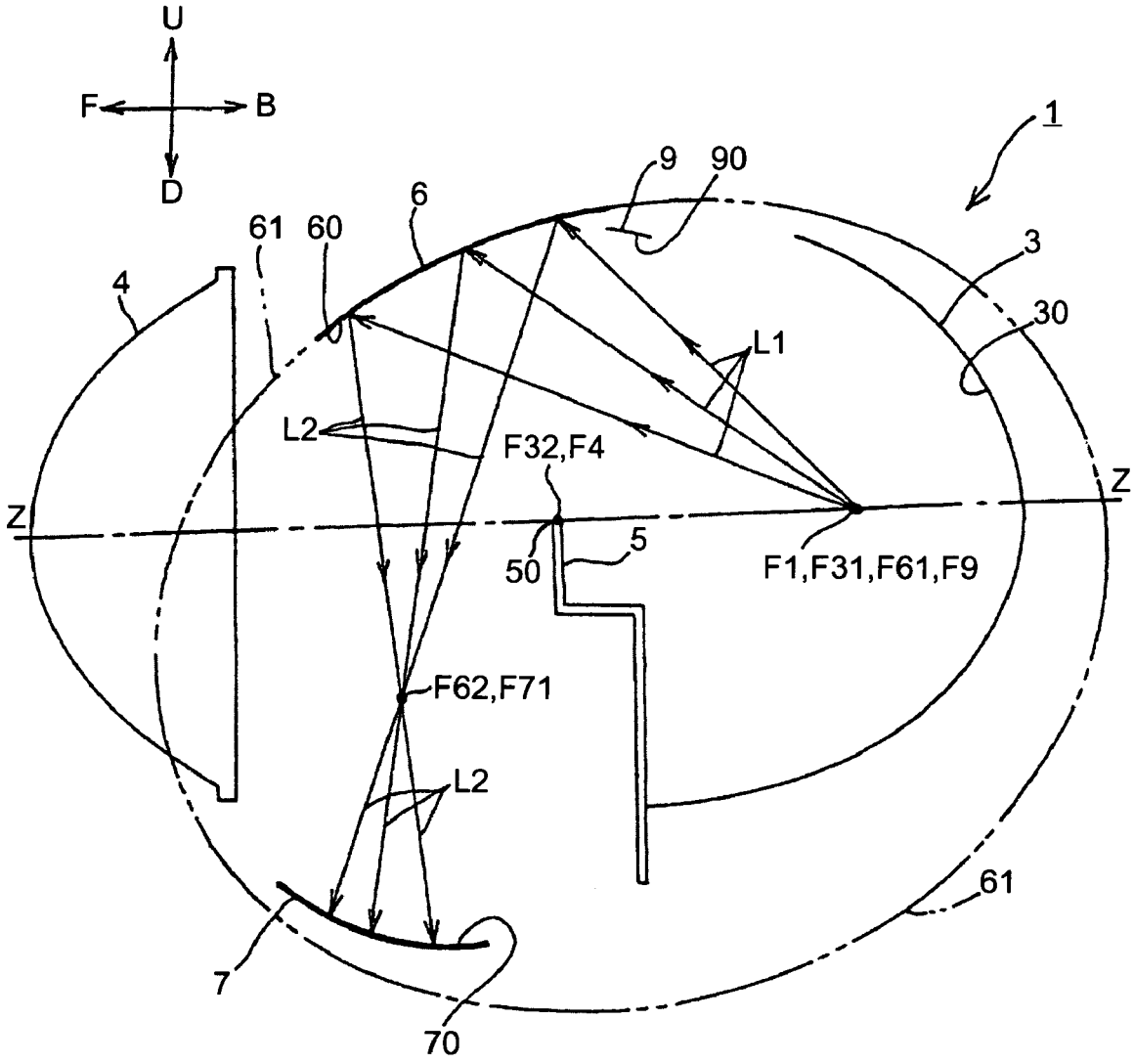
FIG. 6 is a schematic cross-sectional view taken along the line VI—VI shown in FIG. 2.

The first subreflector 6 is arranged between the main reflector 3 and the projector lens 4, so as to oppose an upper and lateral portion of the main reflector 3 (refer to FIGS. 4 and 6). The inner concave surface of the first subreflector 6 is finished with aluminum vapor deposition or silver coating, thus forming a first sub-reflecting surface 60 (NURBS surface or free-form surface), which is substantially an ellipsoid of revolution (refer to an ellipsoid 61 of the double-dashed line in FIG. 6). A first focal point F61 of the first sub-reflecting surface 60 is located on or near the first focal point F31 (and the center F1 of the light emitting section of the light source). The first focal point F61 of the first sub-reflecting surface 60 and the first focal point F31 (and a central portion F1 of the light emitting section of the light source) are located substantially at the same position (refer to FIG. 6). The first subreflector 6 is fixedly held by a holder.

Figure 2:
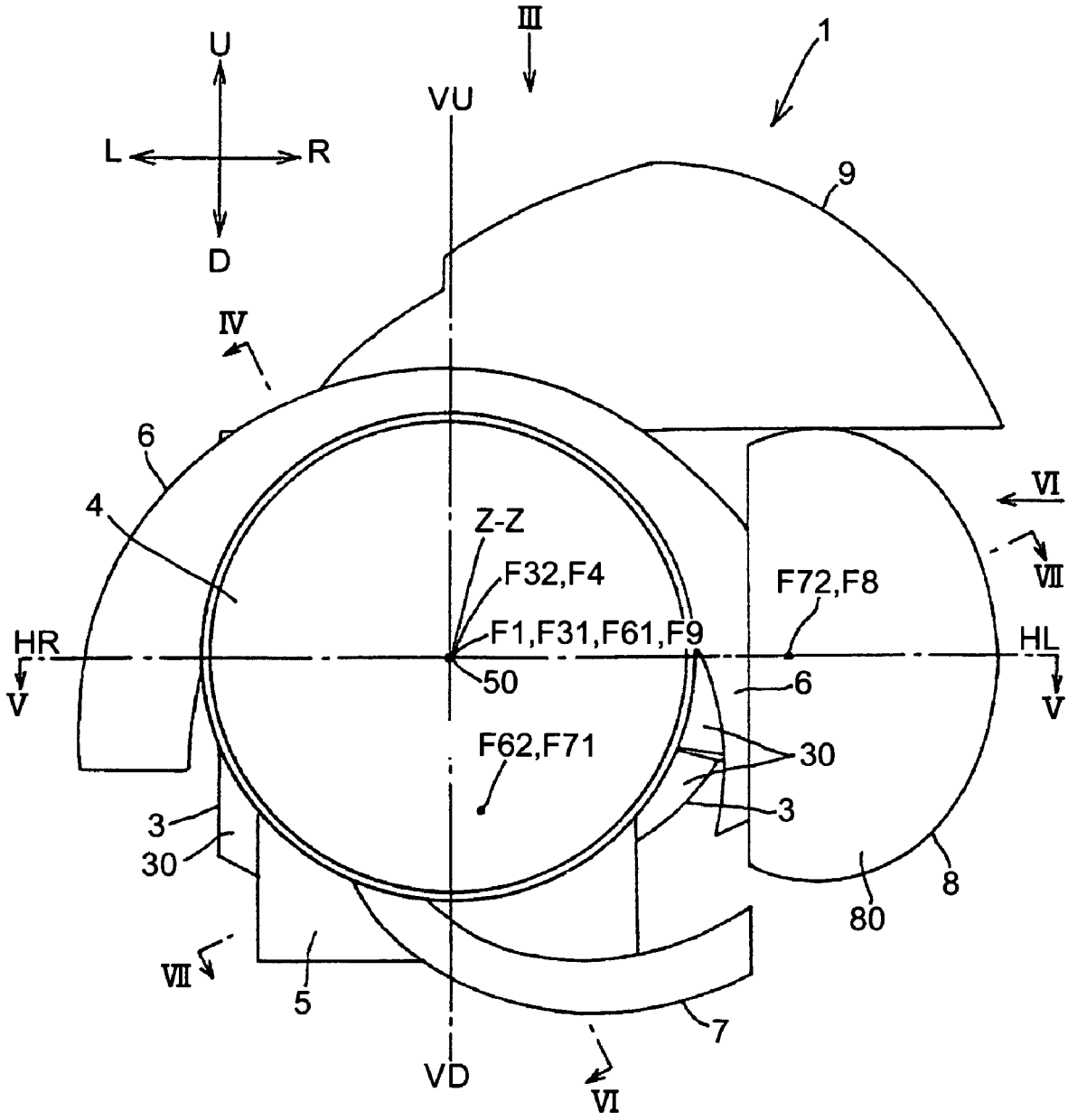
FIG. 2 is a fragmentary front view of the headlamp shown in FIG. 1.

A second focal point F62 of the first sub-reflecting surface 60 is located between the shade 5 and the projector lens 4 (refer to FIGS. 4 to 6), and on a left lower side with respect to the optical axis Z—Z of the main reflecting surface 30 and the projector lens 4 (refer to FIG. 2). The first sub-reflecting surface 60 serves to reflect the light L1 (direct light irradiated upwardly forward by the light source), which usually results in becoming ineffective, out of the light from the light source, toward the second focal point F62 as a reflected light L2 (refer to FIG. 6). Throughout an optical path from the first focal point F61 of the first sub-reflecting surface 60 to the second focal point F62, an obstacle such as the shade 5 is not located.

The second subreflector 7 is located between the shade 5 and the projector lens 4, so as to oppose a lower and right side portion of the first subreflector 6 (refer to FIGS. 4 and 6). The inner concave surface of the second subreflector 7 is finished with aluminum vapor deposition or silver coating, thus forming a second sub-reflecting surface 70 (NURBS surface or free-form surface), which is substantially an ellipsoid of revolution (refer to an ellipsoid 71 of the double-dashed line in FIG. 7). A first focal point F71 of the second sub-reflecting surface 70 is located on or near the second focal point F62. The first focal point F71 and the second focal point F62 are located substantially at the same position refer to FIG. 6). The second subreflector 7 is fixedly held by a holder.

Figure 5:
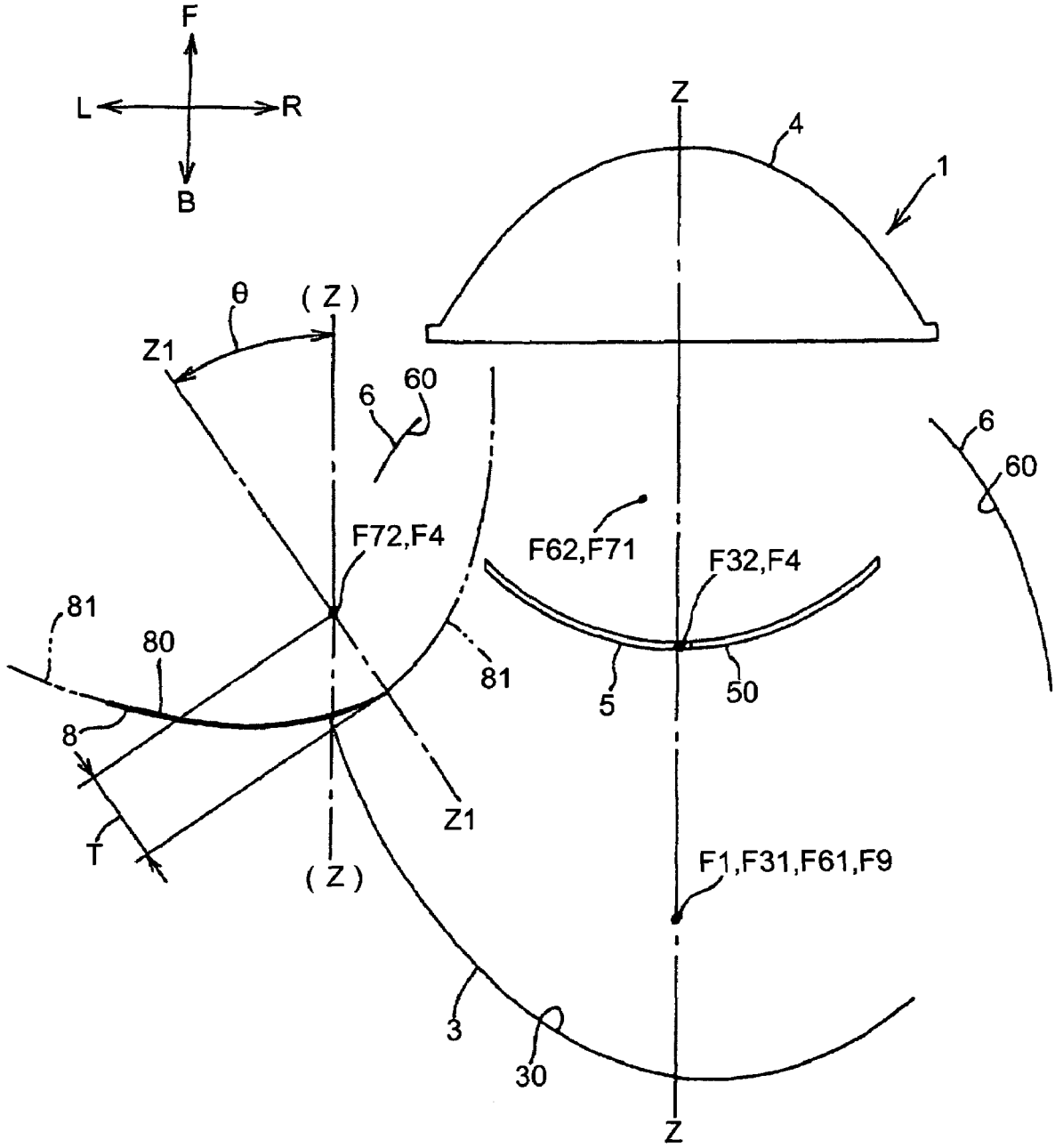
FIG. 5 is a schematic cross-sectional view taken along the line V—V shown in FIG. 2.

A second focal point F72 of the second sub-reflecting surface 70 is located on an outer side of the main reflecting surface 30 and the projector lens 4, the left side of the optical axis Z—Z (refer to FIGS. 2 and 5). The second sub-reflecting surface 70 serves to reflect the reflected light L2 toward the second focal point F72 as a reflected light L3 (refer to FIG. 7). Throughout an optical path from the first focal point F71 to the second focal point F72, no obstacles exist such as the shade 5.

The third subreflector 8 is located between the main reflector 3 and the projector lens 4, so as to oppose an outer left side portion of the second subreflector 7 (refer to FIGS. 2 and 5). The inner concave surface of the third subreflector 8 is finished with aluminum vapor deposition or silver coating, thus forming a third sub-reflecting surface 80 (NURBS surface or free-form surface), which is substantially a paraboloid of revolution (refer to a parabola 81 in double-dashed line in FIGS. 5 and 7). A focal point F8 of the third sub-reflecting surface 80 is located on or near the second focal point F72. The focal point F8 and the second focal point F72 are located substantially at the same position (refer to FIGS. 5 and 7). The third subreflector 8 is fixedly held by a holder.

Figure 3:
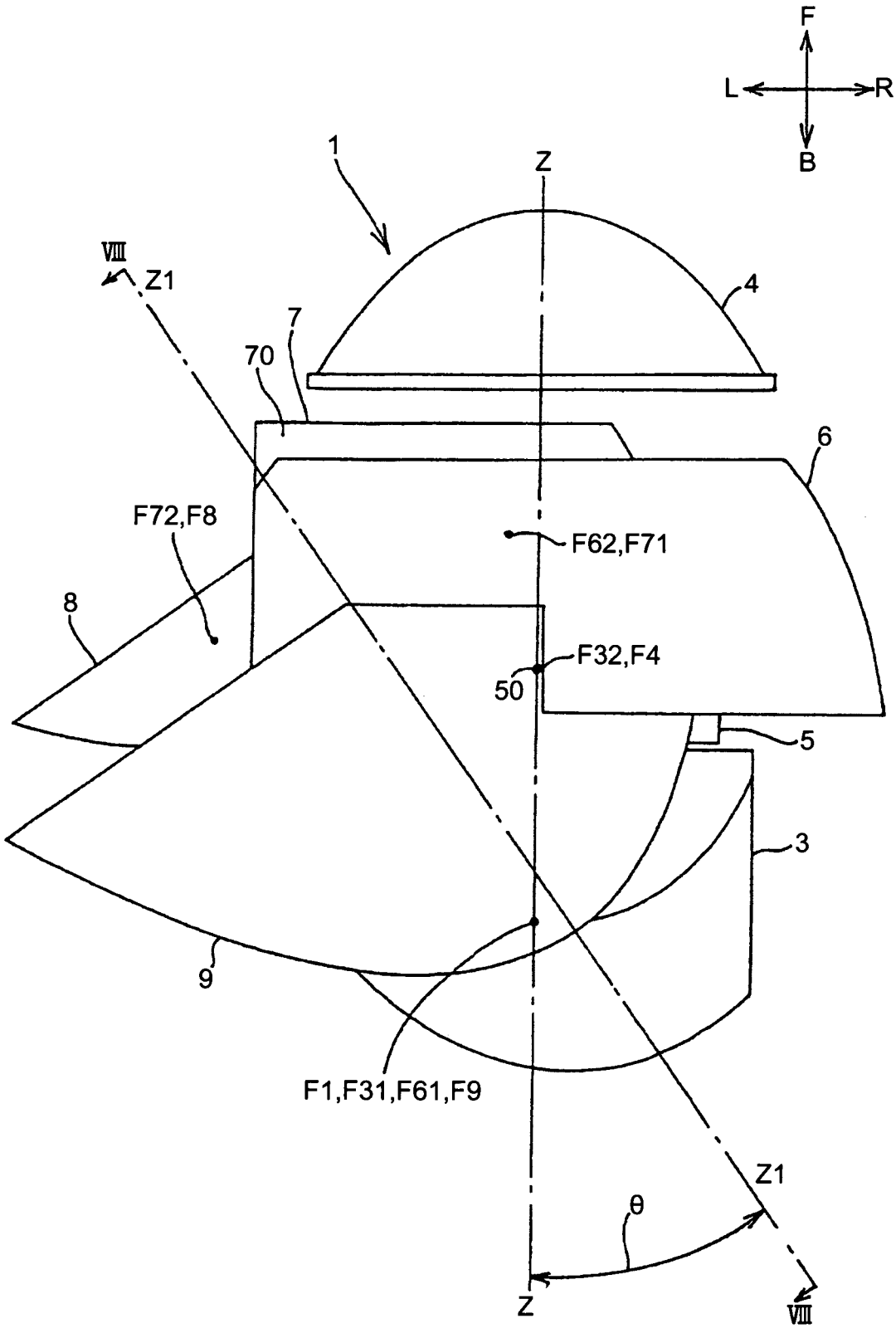
FIG. 3 is a plan view of the headlamp shown in FIG. 2.
Figure 9:
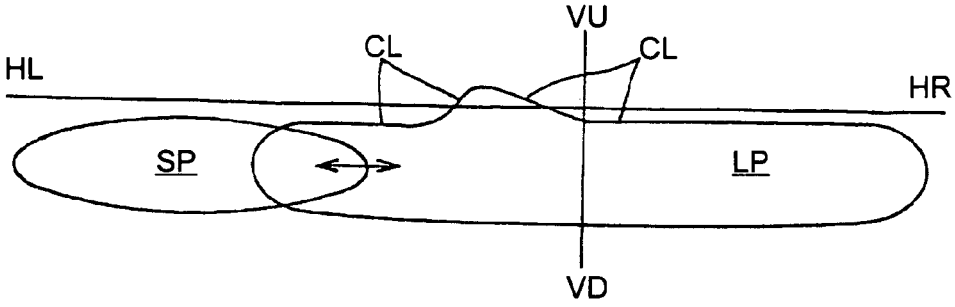
FIG. 9 is a schematic for explaining a passing light distribution pattern and a sub-light distribution pattern when the headlamp shown in FIG. 1 is mounted on the left side of a vehicle.

An optical axis Z1—Z1 of the third sub-reflecting surface 80 is inclined to the left with respect to the optical axis Z—Z ((Z)—(Z) in FIG. 5), by an angle θ (refer to FIGS. 3 and 5). The third sub-reflecting surface 80 serves to reflect the reflected light L3 from the second sub-reflecting surface 70, toward the outside as a reflector light L4, to a left side with respect to the passing light distribution pattern LP (refer to FIG. 7). Consequently, as shown in FIG. 9, a sub-light distribution pattern SP is directed to the left side with respect to the passing light distribution pattern LP. A controller, such as the inner lens 40 constituted of a prism lens, that controls the reflected light L4 from the third subreflector 8 is arranged in front of the third subreflector 8. The angle θ between the optical axis Z1—Z1 and the optical Z—Z is 35 degrees; however, the angle θ can be set to any desirable value. The distance T between the focal point F8 and the ellipsoid 81 is 12 millimeters; however, the distance T can be set to any desirable value.

Figure 8:
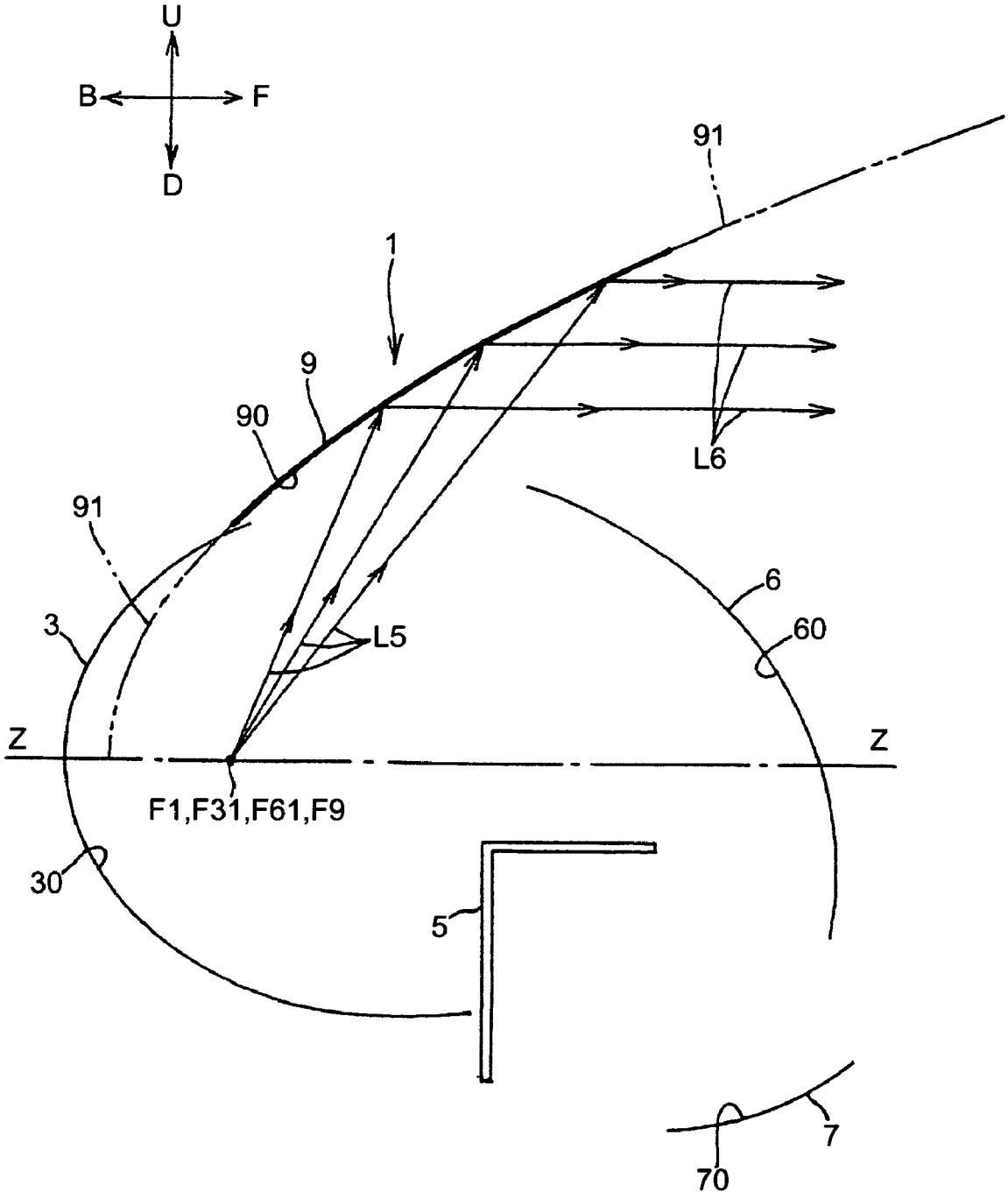
FIG. 8 is a schematic cross-sectional view taken along the line VIII—VIII shown in FIG. 3.

The fourth subreflector 9 is located between the main reflector 3 and the first subreflector 6, and above the main reflector 3, the first subreflector 6 and the third subreflector 8 (refer to FIGS. 2, 4 and 8). The inner concave surface of the fourth subreflector 9 is finished with aluminum vapor deposition or silver coating, thus forming a fourth sub-reflecting surface 90 (NURBS surface or free-form surface), which is substantially a paraboloid of revolution (refer to a parabola 91 in double-dashed line in FIG. 8). A focal point F9 of the fourth sub-reflecting surface 90 is located on or near the first focal point F31 (and the center F1 of the light emitting section of the light source and the first focal point F61 of the first sub-reflecting surface 60). The focal point F9, the first focal point F61 of the first sub-reflecting surface 60 and the first focal point F31 (and the center F1 of the light emitting section of the light source and the first focal point F61 of the first sub-reflecting surface) are located substantially at the same position (refer to FIG. 8). The fourth subreflector 9 is fixedly held by a holder.

An optical axis (not shown) of the fourth sub-reflecting surface 90 substantially coincides with the optical axis Z—Z (refer to FIG. 8). The fourth sub-reflecting surface 90 serves to reflect the ineffective light L5 from the light source (direct light irradiated upwardly forward by the light source, as the ineffective light L1), toward outside as a reflected light L6, to a lower side with respect to the passing light distribution pattern LP. At a forward position of the fourth subreflector 9, a controller that controls the reflected light L6 from the fourth sub-reflecting surface 90 is arranged, such as an inner lens constituted of a prism lens.

The headlamp assembly 100L operates as described hereunder.

First, the light source is turned on. A portion of the light from the light source is reflected by the main reflecting surface 30. The reflected light converges at the second focal point F32 and the focal point F4. A portion of the converged reflected light is cut off by the shade 5. The remaining portion of the reflected light which has not been cut off diffuses through the second focal point F32 and the focal point F4, and proceeds outward through the projector lens 4 to irradiate a forward lateral area. Thus the passing light distribution pattern LP is obtained as shown in FIG. 9.

Referring to FIG. 6, the remaining portion of the light from the light source, i.e. the light L1 which usually results in becoming ineffective without being reflected by the main reflecting surface 30 (direct light irradiated upwardly forward by the light source), being made incident upon the first sub-reflecting surface 60. The light L1, is made incident on the first sub-reflecting surface 60, is thereby reflected to be the reflected light L2, and converges at the second focal point F62 and the first focal point F71. The converged reflected light L2 diffuses through the second focal point F62 and the first focal point F71 and is made incident on the second sub-reflecting surface 70.

Figure 7:
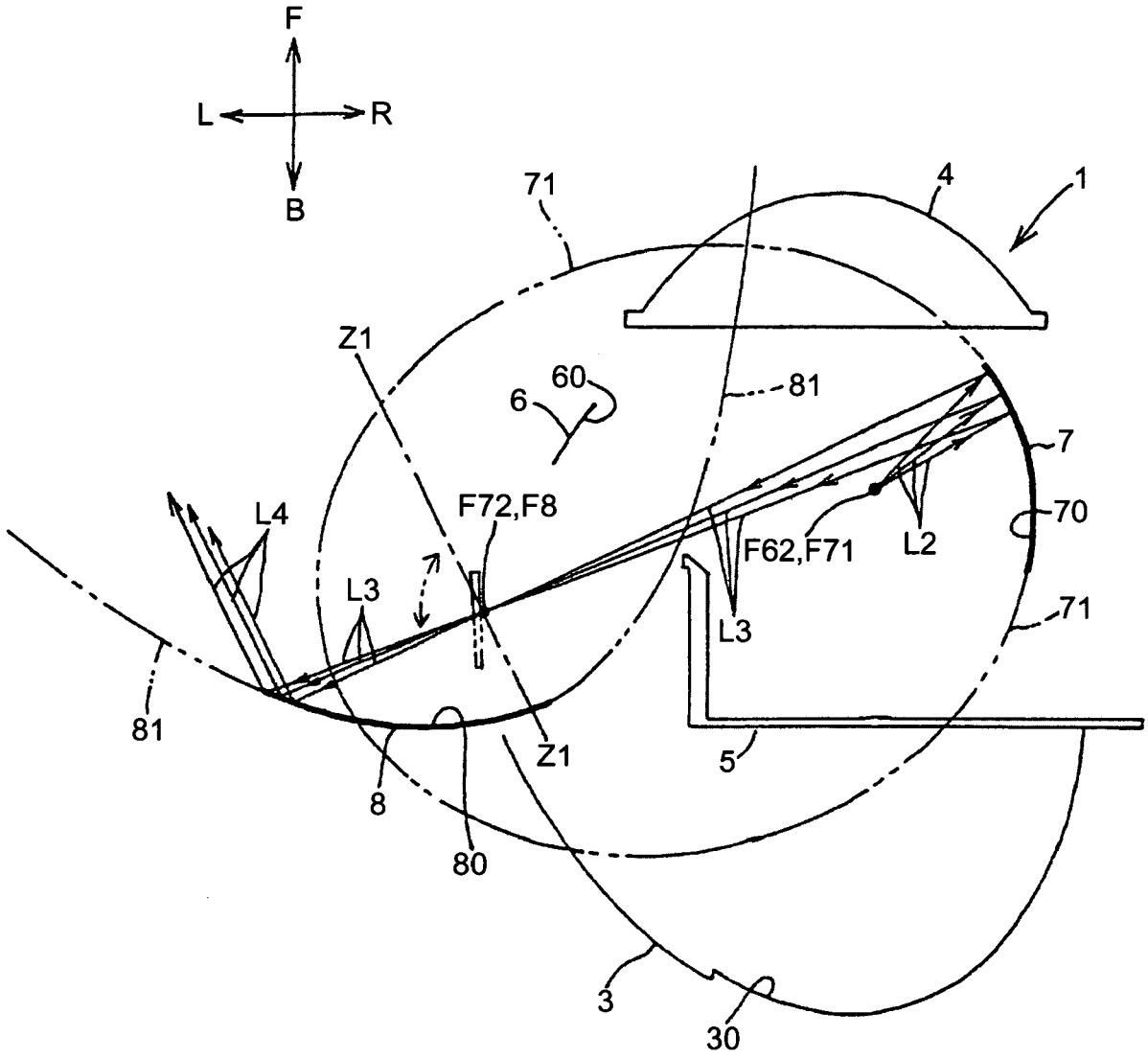
FIG. 7 is a schematic cross-sectional view taken along the line VII—VII shown in FIG. 2.

Referring to FIG. 7, the light L2, being made incident upon the second sub-reflecting surface 70, is thereby reflected to be the reflected light L3, and converges at the second focal point F72 and the focal point F8. The converged reflected light L3 diffuses through the second focal point F72 and the focal point F8 and is made incident on the third sub-reflecting surface 80.

Figure 10:
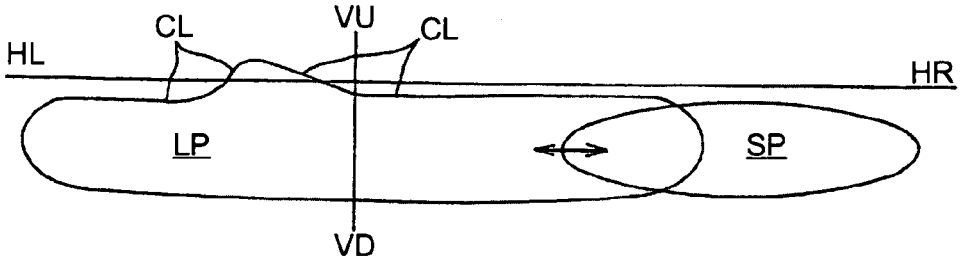
FIG. 10 is a schematic for explaining a passing light distribution pattern and a sub-light distribution pattern when the headlamp shown in FIG. 1 is mounted on the right side of the vehicle.

The light L3, being made incident upon the third sub-reflecting surface 80, is thereby reflected to be the reflected light L4, and proceeds substantially parallel to the optical axis Z1—Z1 toward the inner lens 40. The light L4 then enters the inner lens 40 to be thereby controlled for irradiating outside. Consequently, as shown in FIG. 9, a sub-light distribution pattern SP is obtained on the left side of the passing light distribution pattern LP. When the headlamp is mounted on the right side of the vehicle C, the passing light distribution pattern LP, and the sub-light distribution pattern SP directed to the right side of the passing light distribution pattern LP are obtained as shown in FIG. 10.

Referring to FIG. 8, the light L5 out of the light from the light source, which usually results in becoming ineffective without being reflected by the main reflecting surface 30 (direct light irradiated upwardly forward by the light source, as the ineffective light L1), is made incident on the fourth sub-reflecting surface 90. The light L5, being made incident upon the fourth sub-reflecting surface 90, is thereby reflected to be the reflected light L6, and proceeds outward to irradiate, for example, a lower side with respect to the passing light distribution pattern LP.

Now the merits of the headlamp 1 will be described below.

The headlamp 1 is designed so as to irradiate the light L1 which usually results in becoming ineffective out of the light from the light source, through the first sub-reflecting surface 60 of the first subreflector 6, the second sub-reflecting surface 70 of the second subreflector 7 and the third sub-reflecting surface 80 of the third to irradiate the left outer side and the right outer side with respect to the passing light distribution pattern LP. Accordingly, the headlamp 1 is capable of effectively and efficiently utilizing the ineffective light L1 from the light source to irradiate the left outer side and the right outer side, which are the dead angles of the passing light distribution pattern LP obtained by a conventional projector type headlamp.

Furthermore, since the headlamp 1 directs a majority of the sub-light distribution pattern SP to the left outer side of the passing light distribution pattern LP, a sufficient luminosity (illuminance, quantity of light) can be secured. Further, the headlamp 1 eliminates the need to rotate the third sub-reflector 8 in a large rotation in either direction, thereby allowing to efficiently direct the sub-light distribution pattern SP to the left outer side of the passing light distribution pattern LP.

Specifically, with the headlamp 1, the second focal point F62 is located between the shade 5 and the projector lens 4, and no obstacle exists such as the shade 5 on the optical path from the first focal point F61 of the first sub-reflecting surface 60 to the second focal point F62 (refer to FIG. 6). Likewise, the second focal point F72 is located on the left side of the optical axis Z—Z, and no obstacle exists such as the shade 5 on the optical path from the first local point F71 to the second focal point F72 (refer to FIG. 7). Such a feature permits keeping the ineffective light L1 out of the light source from being blocked by an obstacle such as the shade 5, thus achieving a more effective and efficient utilization of the light L1.

Further, with the headlamp 1, the second focal point F62 is located on the left lower side of the optical axis Z—Z; the second focal point F72 is located on the left side of the optical axis Z—Z; and the optical axis Z1—Z1 is inclined to the left with respect to the optical axis Z—Z. Such configuration allows to efficiently direct the ineffective light L1 from the light source toward the left side and irradiate the outside. In other words, as shown in FIG. 9, the sub-light distribution pattern SP can be efficiently created on the left side of the passing light distribution pattern LP.

Still further, since the headlamp 1 has a fourth sub-reflector 9 having a fourth sub-reflecting surface that reflects the ineffective light L5 from the light source, for example, downwardly with respect to the passing light distribution pattern LP as the reflecting light L6 outward, more efficient utilization of the ineffective light L5 from the light source can be achieved.

Still further, since the headlamp 1 utilizes the ineffective light L1 and L5 directly irradiated upwardly forward by the light source, more effective and more efficient utilization of the ineffective light L1 and L5 from the light source can be achieved, than a conventional headlamp which utilizes an ineffective light directly irradiated downwardly forward by a light source, but blocked by the shade 5.

According to the embodiment, a predetermined light distribution pattern obtained with the main reflecting surface 30 is the passing light distribution pattern LP as shown in FIGS. 9 and 10. However, according to the present invention, the predetermined light distribution pattern may include a motorway light distribution pattern or a driving light distribution pattern. The motorway light distribution pattern has a cut line slightly raised with respect to the cut line CL of the passing light distribution pattern shown in FIGS. 9 and 10, which is suitable for high-speed driving. Such a motorway light distribution pattern can be obtained by slightly lowering the wedge 50 of the shade 5 in the foregoing embodiment. The driving light distribution pattern has a cut line significantly raised with respect to the cut line CL of the passing light distribution pattern LP shown in FIGS. 9 and 10, or does not have a cut line, which is suitable for high-speed driving when encountering to counter-passing vehicle. Such a driving light distribution pattern can be obtained by significantly lowering the wedge 50 of the shade 5, or by removing the shade 5 in the foregoing embodiment.

A movable shade (indicated by a double-dashed line in FIG. 7) can be provided that can move upward and downward or back and forth, arranged between the second sub-reflecting surface 70 and the third sub-reflecting surface 80, and on or near the second focal point F72 and the focal point F8. Such arrangement permits turning on and off the sub-light distribution pattern SP shown in FIGS. 9 and 10, besides adjusting an area of the sub-light distribution pattern SP.

Further, the third subreflector 8 can be rotatably attached (indicated by a double-dashed arrow in FIG. 7) around a substantially vertical axis on or near the second focal point F72 and the focal point F8. Such arrangement allows moving the sub-light distribution pattern SP shown in FIGS. 9 and 10 to the left or to the right, as indicated by a solid line arrow.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A projector-type headlamp comprising:

a main reflector that includes a main reflecting surface that is substantially an ellipsoid of revolution having a first focal point and a second focal point;

the light source located on or substantially close to the first focal point;

a projector lens that projects outward a predetermined light distribution pattern, the projector lens having a third focal point, wherein the projector lens is arranged such that the third focal point is located on or substantially close to the second focal point;

a first subreflector with a first sub-reflecting surface that is substantially an ellipsoid of revolution having a fourth focal point and a fifth focal point, wherein the first subreflector is arranged such that the fourth focal point is located on or substantially close to the first focal point, and the first sub-reflecting surface reflects a portion of light output from the light source that usually results in becoming ineffective toward the fifth focal point;

a second subreflector with a second sub-reflecting surface that is substantially an ellipsoid of revolution having a sixth focal point and a seventh focal point, wherein the second subreflector is arranged such that the sixth focal point is located on or substantially close to the fifth focal point, and the second sub-reflecting surface reflects light reflected from the first sub-reflecting surface toward the seventh focal point;

a third subreflector with a third sub-reflecting surface that is substantially a paraboloid of revolution having an eighth focal point, wherein the third subreflector is arranged such that the eighth focal point is located on or substantially close to the seventh focal point, and the third sub-reflecting surface reflects light reflected from the second sub-reflecting surface toward the outside on a left outer side or a right outer side with respect to the predetermining light distribution pattern.

2. The headlamp according to claim 1, wherein the fifth focal point is located between the light source and the projector lens and no structure exists in an optical path between the fourth focal point and the fifth focal point, and the seventh focal point is located on a left side or a right side and an optical axis of the main reflecting surface and the projector lens and no structure exists in an optical path between the sixth focal point and the seventh focal point.

3. The headlamp according to claim 1, further comprising:

a shade arranged on or near the second focal point and the third focal point so as to cutoff a portion of light reflected from the main reflecting surface to create a predetermined passing light distribution pattern or a predetermined motorway light distribution pattern.

4. The headlamp according to claim 1, wherein the fifth focal point is located on a left lower side or a right lower side of an optical axis of the main reflecting surface and the projector lens, the seventh focal point is located on a left side or a right side of the optical axis of the main reflecting surface and the projector lens, and an optical axis of the third sub-reflecting surface is inclined to the left side or the right side of the optical axis of the main reflecting surface and the projector lens.

5. The headlamp according to claim 1, further comprising:

a shade arranged on or near the second focal point and the third focal point so as to cutoff a portion of light reflected from the main reflecting surface to create a predetermined passing light distribution pattern or a predetermined motorway light distribution pattern, wherein the fifth focal point is located between the light source and the projector lens and on a left lower side or a right lower side of an optical axis of the main reflecting surface and the projector lens and the shade does not exists in an optical path between the fourth focal point and the fifth focal point, the seventh focal point is located on a left side or a right side of an optical axis of the main reflecting surface and the projector lens and the shade does not exists in an optical path between the sixth focal point and the seventh focal point, and an optical axis of the third sub-reflecting surface is inclined to the left side or the right side of the optical axis of the main reflecting surface and the projector lens.

6. The headlamp according to claim 1, further comprising:

a fourth subreflector with a fourth sub-reflecting surface that is substantially a paraboloid of revolution having a ninth focal point, wherein the fourth subreflector is arranged such that the ninth focal point is located on or substantially close to the first focal point, and the fourth sub-reflecting surface reflects the portion that usually results in becoming ineffective out of the light from the light source toward the outside on a desired position with respect to the predetermined light distribution pattern.

7. The headlamp according to claim 1, further comprising:

a shade movably arranged between the second sub-reflecting surface and the third sub-reflecting surface so as to turn on and off a sub-light distribution pattern formed on a left outer side or a right outer side of the predetermined light distribution pattern by light reflected from the third sub-reflecting surface and adjust an area of the sub-light distribution pattern.

8. The headlamp according to claim 1, wherein the third subreflector is rotatably attached around a substantially vertical axis.

* * * * *